US011737556B1

(12) United States Patent
Saterbak et al.

(10) Patent No.: US 11,737,556 B1
(45) Date of Patent: Aug. 29, 2023

(54) FREESTANDING FOLDING TABLE

(71) Applicants: Baron Saterbak, Scottsdale, AZ (US); Mallory Heroldt, Phoenix, AZ (US)

(72) Inventors: Baron Saterbak, Scottsdale, AZ (US); Mallory Heroldt, Phoenix, AZ (US)

(73) Assignee: The Folding Table LLC, Las Vegas, NV (US)

( * ) Notice: Subject to any disclaimer, the term of this patent is extended or adjusted under 35 U.S.C. 154(b) by 0 days.

(21) Appl. No.: 18/077,834

(22) Filed: Dec. 8, 2022

(51) Int. Cl.
*A47B 13/08* (2006.01)

(52) U.S. Cl.
CPC ..... *A47B 13/081* (2013.01); *A47B 13/088* (2013.01)

(58) Field of Classification Search
CPC ..... A47B 13/081; A47B 13/088; A47B 3/00; A47B 45/00; A47B 1/04
USPC ..... 108/77, 90, 115
See application file for complete search history.

(56) References Cited

U.S. PATENT DOCUMENTS 3,322,077 A * 5/1967 Kovacik ..... A47B 3/00 108/115
3,527,174 A * 9/1970 Lay ..... A47B 31/04 108/115
4,330,151 A * 5/1982 Healey ..... A47B 83/02 182/132
4,715,296 A * 12/1987 Wilkinson ..... A47C 12/02 108/132
5,644,994 A * 7/1997 Liang ..... A47B 3/083 108/115
5,904,104 A * 5/1999 Yu ..... A47B 3/00 108/115
6,036,150 A * 3/2000 Lehrman ..... D06F 39/12 211/186
6,386,378 B1 * 5/2002 Scharing ..... D06F 39/12 108/90
7,703,726 B2 4/2010 Harrison
7,975,626 B1 * 7/2011 Wang ..... A47B 3/002 108/50.01
8,015,928 B2 * 9/2011 Chen ..... A47B 77/06 108/115
8,479,542 B2 * 7/2013 Kendall ..... D06F 39/12 68/3 R
9,125,485 B2 9/2015 Nafziger
10,214,351 B2 * 2/2019 Duppong ..... A47B 96/00
D947,577 S * 4/2022 Hu ..... D6/654.1
11,564,487 B2 * 1/2023 Hsu ..... A47B 96/024
2003/0024444 A1 * 2/2003 Welch ..... A47F 5/137 108/115
2003/0177960 A1 * 9/2003 Schenker ..... A47B 3/0803 108/115
2004/0094075 A1 * 5/2004 Norstad ..... A47F 5/13 108/115

(Continued)

FOREIGN PATENT DOCUMENTS

GB 2184007 A * 6/1987 ..... A47B 45/00

OTHER PUBLICATIONS

Zoe Hunt, The Easiest DIY Laundry Room Shelf Over Washer Dryer, Pine + Poplar, Website, US.

*Primary Examiner* — Jose V Chen
(74) *Attorney, Agent, or Firm* — Akaweih Law; Nadia S. Akaweih; Maymanat S. Afshar

(57) ABSTRACT

A freestanding folding table is capable of being placed over a washer, dryer, or both, and any utility tub creating an easily accessible laundry folding space.

16 Claims, 14 Drawing Sheets

(56) References Cited

U.S. PATENT DOCUMENTS

| | | | | |
|---|---|---|---|---|
| 2005/0274300 | A1* | 12/2005 | Chen | A47B 3/002 108/115 |
| 2007/0040482 | A1 | 2/2007 | Williams | |
| 2008/0017083 | A1* | 1/2008 | VanNimwegen | A47B 3/0803 108/115 |
| 2012/0055380 | A1* | 3/2012 | Chung | A47B 3/06 108/127 |
| 2013/0014674 | A1 | 1/2013 | Burkhalter | |
| 2022/0127777 | A1* | 4/2022 | Underly | A47B 88/42 |

* cited by examiner

600

FREESTANDING FOLDING TABLE

FIELD OF THE INVENTION

The present invention is directed to a freestanding folding table that is capable of being placed over a washer, dryer, or both, and any utility tub creating an easily accessible space.

BACKGROUND OF THE INVENTION

A common problem that most laundry device owners face is the lack of available vertical space above residential washers and dryers. Laundry, or utility rooms, vary by size, storage space, and available folding space. In some laundry rooms, countertops are available for users to fold their clean clothes on or store their detergent. In other laundry rooms, the available storage or folding space is significantly smaller. Detergent and dryer sheets are stored on small shelves above the appliance or even just on top of the washer or dryer. In laundry rooms with limited space, folding clean clothes can be difficult or even impossible.

In addition, some individuals may find it difficult to reach shelving that is located at a high height above a washer and/or dryer. In some instances, shelving cannot be placed above a washer or dryer due to limited spacing in the laundry room.

Therefore, there exists a need for a freestanding folding table that fits securely over a residential side-by-side washer and/or dryer or a utility tub that has adjustable tabletops for easy access to those appliances.

SUMMARY OF THE INVENTION

The present invention is directed to a freestanding folding table that fits securely over a residential side-by-side washer and dryer. The present invention can also be used with utility tubs providing more space in small places such as a garage or residential storage rooms.

In one embodiment, the freestanding folding table comprises a first top, wherein the first top comprises a first upper surface and a first lower surface; a leg assembly, wherein the leg assembly comprises a first leg, a second leg, a first support bar, and a third support bar, wherein the first leg is perpendicular to and permanently attached to the first support bar and the third support bar; the second leg is perpendicular to and permanently attached to the first support bar and the third support bar, and the first leg and second leg are parallel to each other; a second top, wherein the second top comprises a second upper surface and a second lower surface; a plurality of hinge bars, wherein the hinge bars comprise a first end, a second end, and a plurality of fasteners, wherein the first end is fixedly attached to the lower surface of the third top using the plurality of fasteners; and the second end of the hinge bar is fixedly attached to first lower surface of the first top enabling the first top to hinge upward toward the third top; and a means of attachment.

In an alternate embodiment, the freestanding folding table further comprises a first support arm, wherein the first support arm comprises a first support arm upper surface and a first support arm lower surface; and a second support arm, wherein the second support arm comprises a second support arm upper surface and a second support arm lower surface; wherein the first support arm upper surface of the first support arm is permanently attached to the first support lower surface of the first top using the plurality of fasteners, and the first support arm lower surface of the first support arm is permanently attached to the first support bar of the leg assembly, and the second arm upper surface of the second arm is permanently attached to the first lower surface of the first top using a plurality of fasteners, and the second support arm lower surface of the second support arm is permanently attached to the first support bar of the leg assembly.

In yet another embodiment, the freestanding folding table further comprises a third top, wherein the third top comprises a third upper surface and a third lower surface; a first support arm, wherein the first support arm comprises a first support arm upper surface and a first support arm lower surface; and a second support arm, wherein the second support arm comprises a second support arm upper surface and a second support arm lower surface; the first support arm upper surface of the first support arm is permanently attached to the first lower surface of the first top using a plurality of fasteners; the first support arm lower surface of the first support arm is permanently attached to the first support bar of the leg assembly; the second support arm upper surface of the second support arm is permanently attached to the second lower surface of the second top using a plurality of fasteners; and the second support arm lower surface of the second support arm is permanently attached to the first support bar of the leg assembly.

In this embodiment, the freestanding folding table further comprises a latch mechanism, wherein the latch mechanism comprises a first latch rail and a second latch rail, wherein the first latch rail is permanently affixed to the first lower surface; the second latch rail is permanently affixed to the second lower surface using a plurality of fasteners; and the first latch rail and the second latch rail align; a slide latch, wherein the slide latch is movable between the first latch rail and the second latch rail; and a lever, located on the slide latch enabling movement of the slide latch between the first top and the second top.

In yet another embodiment, the leg assembly further comprises a third leg, a fourth leg, a second support bar, a plurality of depressible buttons, and a plurality of holes, wherein the first leg is of a smaller diameter than the third leg; the second leg is of a smaller diameter than the fourth leg; the third leg readily accepts the first leg by inserting one of the depressible buttons in one of the plurality of holes and the fourth leg readily accepts the second leg, by inserting one of the depressible buttons in one of the plurality of holes; and the height of the leg assembly is adjusted by moving one of the plurality of depressible buttons to a higher or lower the plurality of holes in the third leg and the fourth leg.

In an embodiment, the freestanding folding table further comprises a plurality of foot levelers permanently attached to the ends of the third leg and the fourth leg.

In another embodiment, the freestanding folding table further comprises a third leg assembly.

In one embodiment, the freestanding folding table means of attachment comprises a plurality of fasteners. In an alternate embodiment, the freestanding folding table means of attachment comprises of welding.

In an alternate embodiment, the freestanding folding table comprises a first top, wherein the first top comprises a first upper surface and a first lower surface; a second top, wherein the second top comprises a second upper surface and a second lower surface; a leg assembly, wherein the leg assembly comprises a first leg, a second leg, a first support bar, and a third support bar, wherein the first leg is perpendicular to and permanently attached to the first support bar and the third support bar; the second leg is perpendicular to and permanently attached to the first support bar and the third support bar; and the first leg and second leg are parallel to each other, a third top.

In an embodiment, the third top comprises a third upper surface and a third lower surface; a plurality of hinge bars, wherein the hinge bars comprise a first end, a second end, and a plurality of fasteners; at least two hinge bars are permanently affixed to first top; the first end is fixedly attached to the lower surface of the third top using the plurality of fasteners and the second end of the hinge bar is fixedly attached to the first lower surface of the first top enabling the first top to hinge upward toward the third top; and at least two hinge bars are permanently affixed to second top, wherein the first end is fixedly attached to the lower surface of the third top using a plurality of fasteners and the second end of the hinge bar is fixedly attached to second lower surface of second top; and a means of attachment.

In another embodiment, the freestanding folding table further comprises a first support arm and a second support arm, wherein the first support arm comprises a first support arm upper surface and a first support arm lower surface; the second support arm comprises a second support arm upper surface and a second support arm lower surface; the first support arm upper surface of the first support arm is permanently attached to the first lower surface of the first top using a plurality of fasteners; the first support arm lower surface of the first support arm is permanently attached to the first support bar of the leg assembly; the second support arm upper surface of the second support arm is permanently attached to the second lower surface of the second top using a plurality of fasteners; and the second support arm lower surface of the second support arm is permanently attached to the first support bar of the leg assembly.

In yet another embodiment, the freestanding folding table further comprises a latch mechanism, wherein the latch mechanism comprises a first latch rail and a second latch rail; wherein the first latch rail is permanently affixed to the first lower surface; the second latch rail is permanently affixed to the second lower surface using the plurality of fasteners; and the first latch rail and the second latch rail align, a slide latch, wherein the slide latch is movable between the first latch rail and the second latch rail; and a lever, located on the slide latch enabling movement of the slide latch between the first top and the second top.

In an alternate embodiment, the leg assembly further comprises a third leg, a fourth leg, a second support bar, a plurality of depressible buttons, and a plurality of holes; the first leg is of a smaller diameter than the third leg; the second leg is of a smaller diameter than the fourth leg; the third leg readily accepts the first leg by inserting one of the depressible buttons in one of the plurality of holes and the fourth leg readily accepts the second leg by inserting one of the depressible buttons in one of the plurality of holes, and the height of the leg assembly is adjusted by moving one of the depressible buttons to a higher or lower one of the plurality of holes in the third leg and the fourth leg.

In yet another embodiment, the freestanding folding table further comprises a third leg assembly.

In one embodiment, the freestanding folding table means of attachment comprises a plurality of fasteners. In another embodiment, the freestanding folding table means of attachment comprises of welding.

In another embodiment, the freestanding folding table comprises a first top, wherein the first top comprises a first upper surface and a first lower surface; a second top, wherein the second top comprises a second upper surface and a second lower surface; a plurality of posts, wherein the posts are permanently affixed to the first lower surface and the second lower surface; a leg assembly, wherein the leg assembly comprises a first leg, a second leg, a third leg, a fourth leg, a first middle leg support, a second middle leg support, and a third support bar; wherein the first leg, the first middle leg support, and the third leg form a telescoping leg.

In an embodiment, the second leg, the second middle leg support, and the fourth leg form a telescoping leg enabling the leg assembly to be height adjustable; and the telescoping legs are parallel to each other and permanently affixed to and perpendicular to the first support bar and the third support bar; a plurality of hinge bars, wherein the hinge bars comprise a first end, a second end, and a plurality of fasteners; wherein the first end is fixedly attached to the first support bar of the leg assembly using a plurality of fasteners; the second end of the hinge bar is fixedly attached to the first lower surface of the first top enabling the first top to hinge inward toward the second top; the first end is fixedly attached to the first support bar of the leg assembly using the plurality of fasteners and the second end of the hinge bar is fixedly attached to the second lower surface of second top enabling the second top to hinge inward toward the first top; and a means of attachment.

In one embodiment, the freestanding folding table means of attachment comprises a plurality of fasteners. In another embodiment, the freestanding folding table means of attachment comprises of welding.

In yet another embodiment, the freestanding folding table, comprises a first top; a second top; and a leg assembly, wherein the leg assembly comprises a first leg, wherein the first leg comprises of a groove on the inside surface of the first leg; a second leg, wherein the second leg comprises of a groove on the inside surface of the second leg; a first support bar; and a third support bar; wherein the first leg is perpendicular to and permanently affixed to the third support bar using a plurality of fasteners, the second leg is perpendicular to and permanently affixed to the third support bar using a plurality of fasteners, and the first leg and the second leg are parallel to each other with the grooves facing each other, capable of accepting the first top or the second top.

Various objects, features, aspects, and advantages of the inventive subject matter will become apparent from the following detailed description of exemplary embodiments, along with the accompanying figures in which like numerals represent like components.

DETAILED DESCRIPTION OF THE INVENTION

Figure 1:
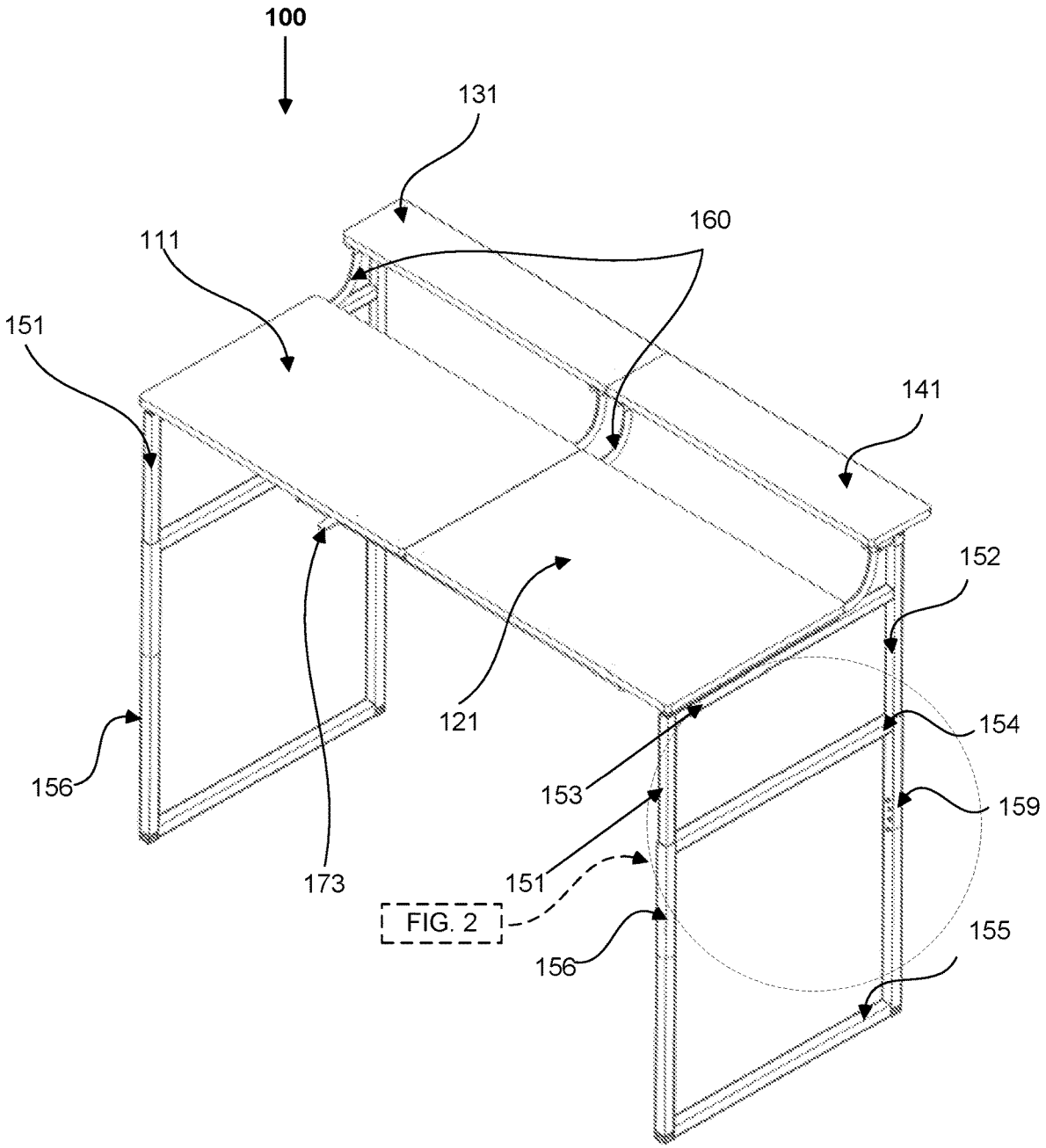
FIG. 1 depicts the front perspective view of an exemplary embodiment of a freestanding folding table.

The following description is not an admission that any of the information provided herein is prior art or relevant to the present invention, or that any publication specifically or implicitly referenced is prior art. Any publications cited in the description are incorporated by reference herein. Where a definition or use of a term in an incorporated reference is inconsistent or contrary to the definition of that term provided herein, the definition of that term provided herein applies and the definition of that term in the reference does not apply.

As used in the description herein and throughout the claims that follow, the meaning of "a," "an," and "the" includes plural reference unless the context clearly dictates otherwise. Also, as used in the description herein, the meaning of "in" includes "into" and "on" unless the context clearly dictates otherwise.

As used herein, the term "about" in conjunction with a numeral refers to a range of that numeral starting from 10% below the absolute value of the numeral to 10% above the absolute value of the numeral, inclusive.

As used herein, the terms "freestanding folding table" and "folding table" are used interchangeably throughout the disclosure.

The present invention is directed to a freestanding folding table that fits securely over a residential side-by-side washer and/or dryer, and a utility tub. The folding table is easy to install in a laundry room or any other tight space, which does not cause any permanent damage to the drywall. In addition, the folding table is height adjustable, configured to fit in any laundry room.

Exemplary configurations of the present invention are depicted in FIGS. 1-14, in which a freestanding folding table is configured to be height adjustable and fit above a washer, a dryer, or both and a utility tub.

In an exemplary embodiment, freestanding folding table 100 comprises first top 110, second top 120, third top 130, and fourth top 140; a plurality of leg assembly 150, at least three hinge bars 160, latch mechanism 170, first support arm 180, and second support arm 183. In an embodiment, first top 110 comprises first upper surface 111 and first lower surface 112; second top 120 comprises second upper surface 121 and second lower surface 122; third top 130 comprises third upper surface 131 and third lower surface 132; and fourth top 140 comprises fourth upper surface 141 and fourth lower surface 142 (see FIGS. 1-7).

In an exemplary embodiment, each hinge bar 160 comprises first end 161, second end 162, and a plurality of fasteners 163; wherein first end 161 is fixedly attached to third lower surface 132 of third top 130 using a plurality of fasteners 163; and wherein second end 162 of hinge bar 160 is fixedly attached to first lower surface 112 of first top 110. Likewise, first end 161 is fixedly attached to fourth lower surface 142 of fourth top 140 using a plurality of fasteners 163; wherein second end 162 of hinge bar 160 is fixedly attached to second lower surface 122 of second top 120. In this embodiment, freestanding folding table 100 is configured to have two tops that open independently. For example, first top 110 can be lifted up engaging hinge bars 160 connected to first lower surface 112 while second top 120 remains in the closed or down position. In the alternative, second top 120 can be lifted up engaging hinge bars 160 connected to second lower surface 122 while first top 110 remains in the closed or down position.

In one embodiment, folding table 100 comprises two leg assemblies 150 located at the lateral outer end of first top 110 and second top 120 providing vertical support at such ends of each first and second top 110 and 120 respectively. Each leg assembly 150 comprises first leg 151, second leg 152, first support bar 153, and third support bar 155; wherein the ends of first support bar 153 are permanently attached to the upper portion of leg assembly 150 between first leg 151 and second leg 152 and the ends of third support bar 155 are permanently attached to the lower portion of leg assembly 150 between first leg 151 and second leg 152. In an embodiment, second support bar 154 is permanently attached to the middle portion of leg assembly 150 between first leg 151 and second leg 152 by plurality of fasteners 163. In an alternate embodiment, the means of attachment for the leg assembly comprises welding, soldering or brazing.

In yet another embodiment, leg assembly 150 comprises first leg 151, second leg 152, and first support bar 153; wherein first support bar 153 is permanently attached and is perpendicular to first leg 151 and second leg 152 using plurality of fasteners 163; and first leg 151 and second leg 152 are parallel to each other.

In an exemplary embodiment, leg assembly 150 is height adjustable and comprises first leg 151, second leg 152, third leg 156, fourth leg 157, first support bar 153, second support bar 154, and third support bar 155; wherein first leg 151 and second leg 152 comprise a plurality of depressible buttons 158, third leg 156 and fourth leg 157 comprise a plurality of holes 159. In an embodiment, first support bar 153 is permanently attached and is perpendicular to first leg 151 and second leg 152. Third support bar 155 is permanently attached to and is perpendicular to third leg 156 and fourth leg 157.

Figure 2:
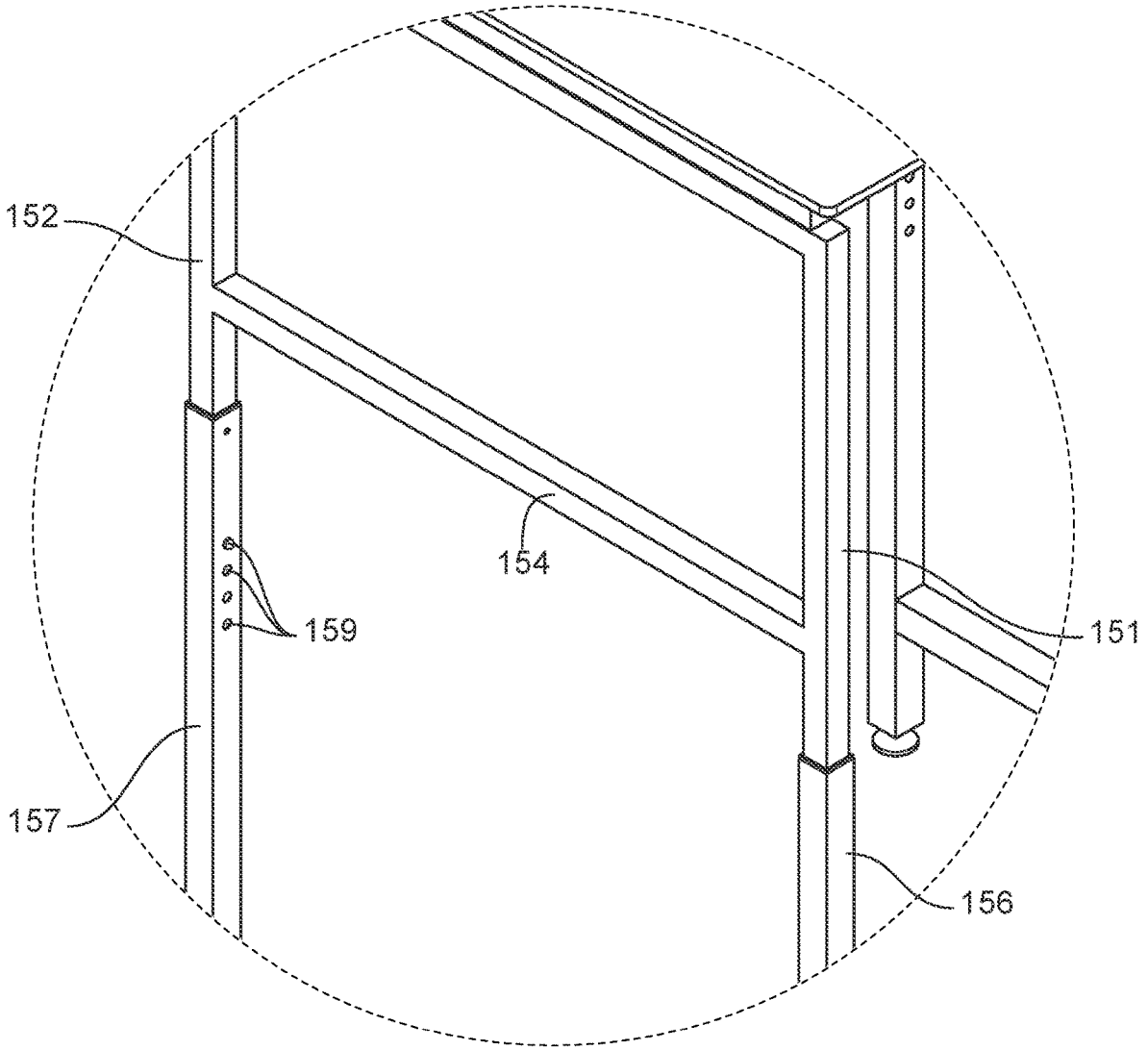
FIG. 2 depicts a close-up perspective view of an exemplary embodiment of a leg assembly on a freestanding folding table.
Figure 3:
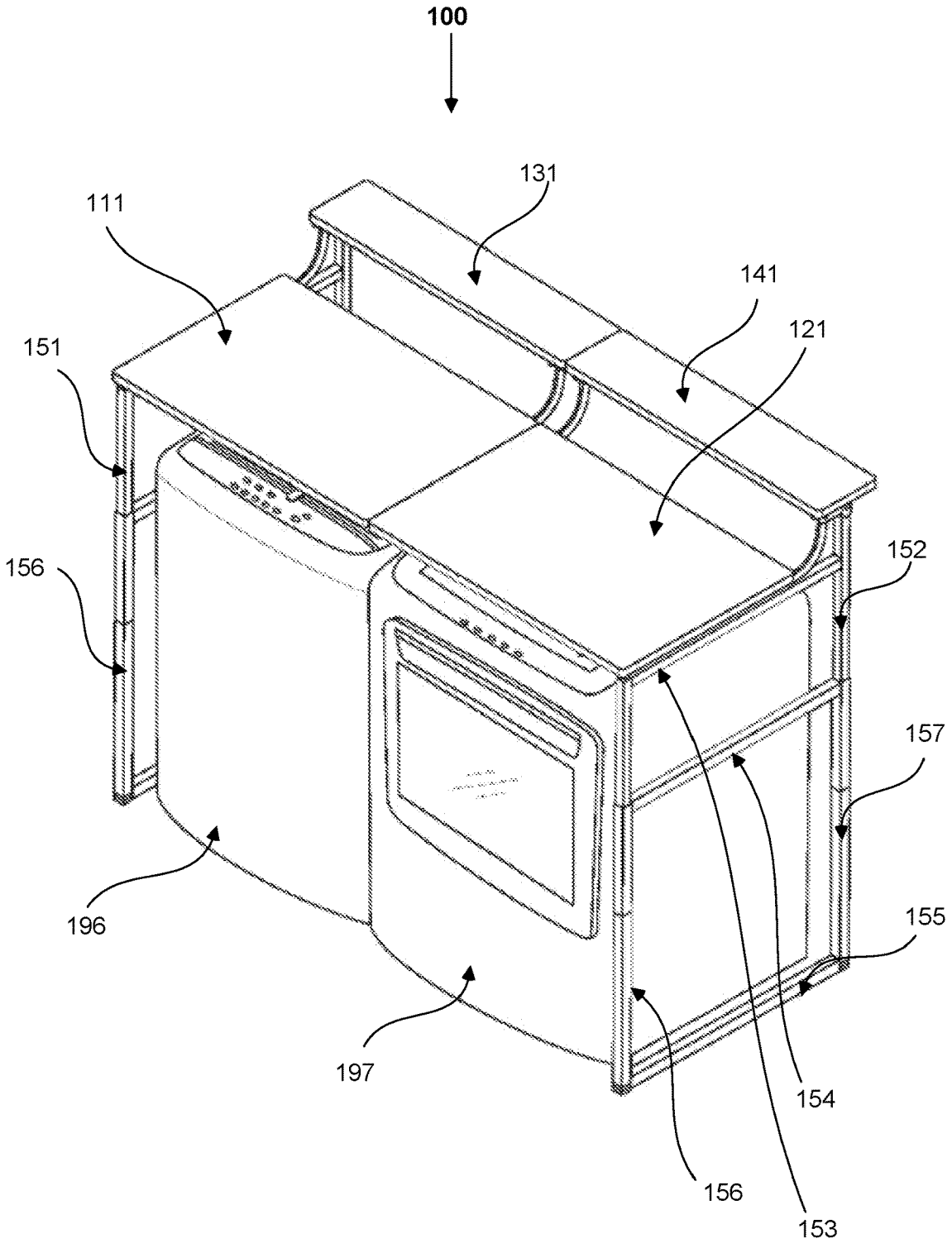
FIG. 3 depicts a front perspective view of an exemplary embodiment of a freestanding folding table placed over a residential washer and dryer.
Figure 4:
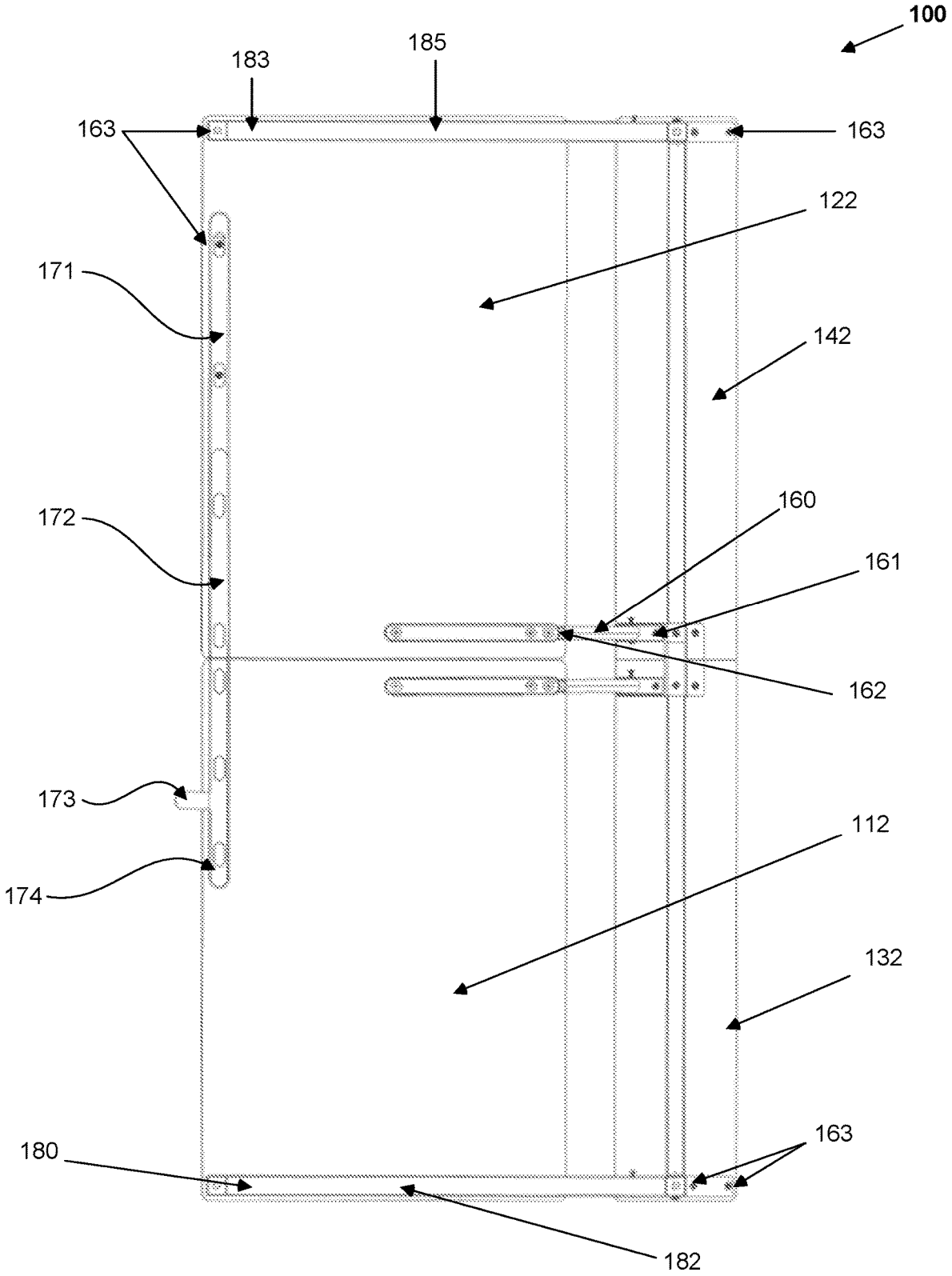
FIG. 4 depicts the bottom view of an exemplary embodiment of a freestanding folding table.
Figure 5:
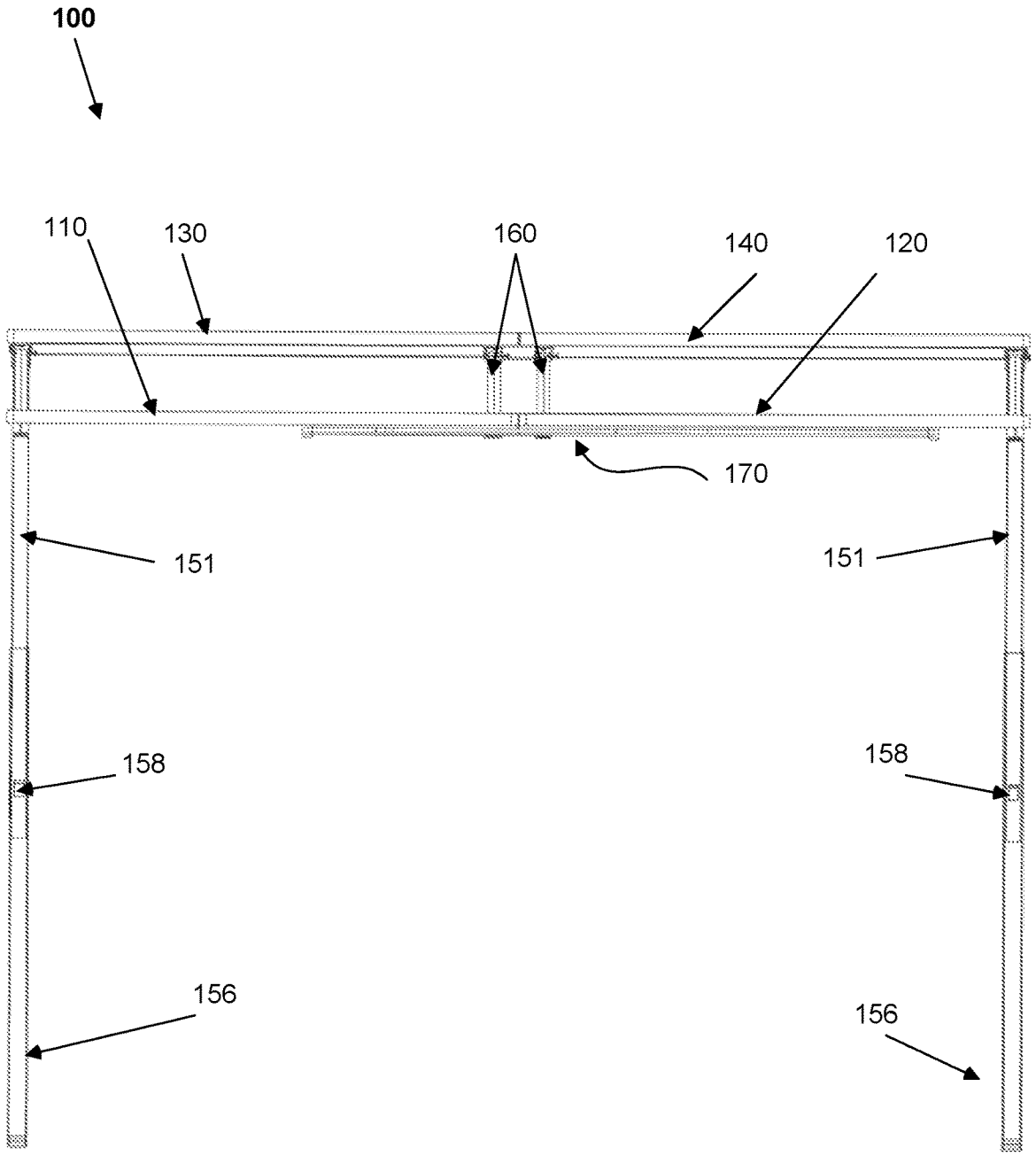
FIG. 5 depicts the front view of an exemplary embodiment of a freestanding folding table.
Figure 6:
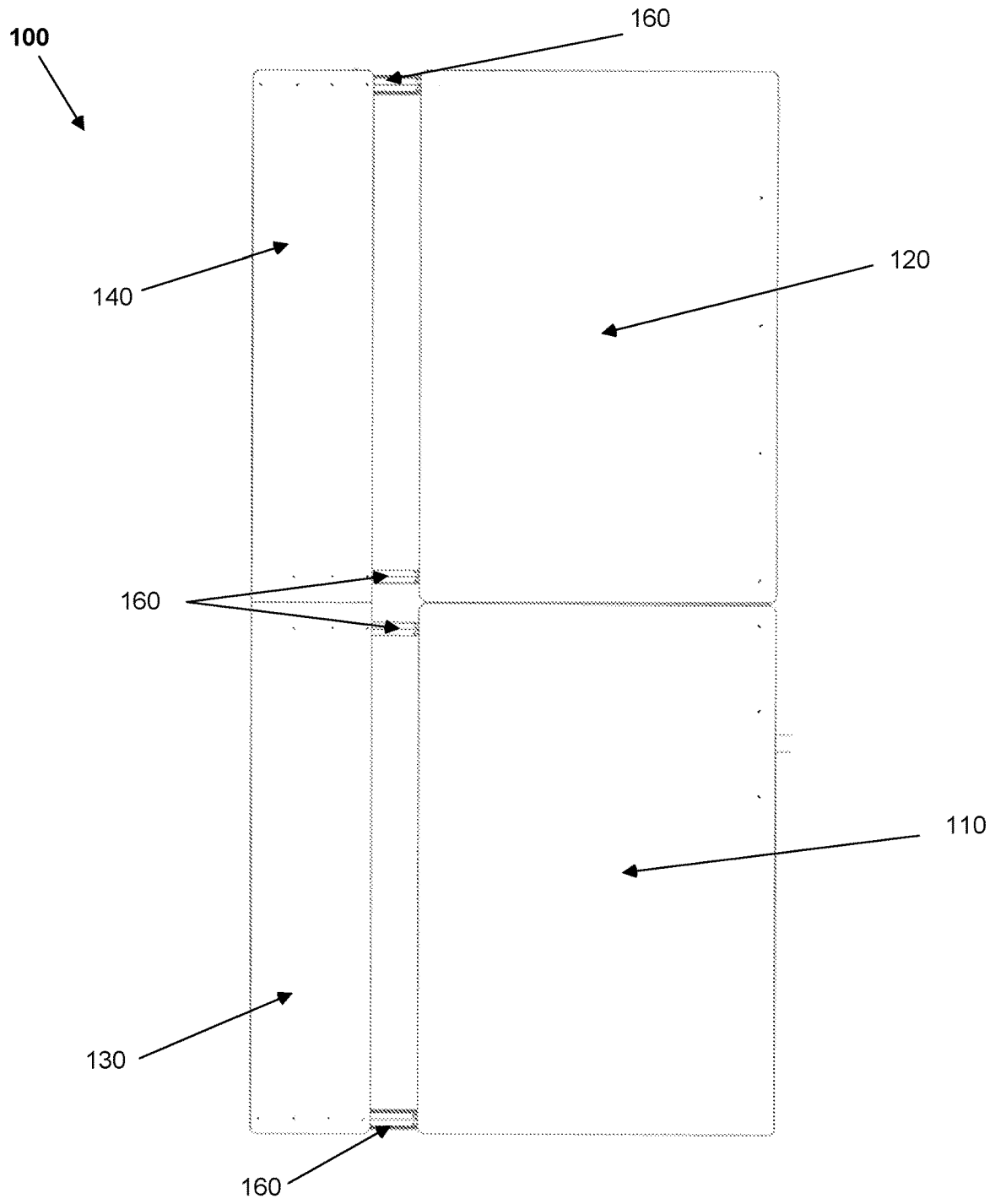
FIG. 6 depicts the top view of an exemplary embodiment of a freestanding folding table.

In this embodiment, first leg 151 comprises a smaller diameter than third leg 156 enabling first leg 151 to fit inside third leg 156, and second leg 152 is of a smaller diameter than fourth leg 157 enabling second leg 152 to fit inside fourth leg 157 thus allowing folding table 100 to be height adjustable ranging from about 38" to about 50" (see FIG. 2).

In this embodiment, third leg 156 is removably attached to first leg 151 by engaging one of plurality of depressible buttons 158 and inserting button 158 into one of plurality of holes 159. Likewise, fourth leg 157 is removably attached to second leg 152 by engaging one of plurality of depressible buttons 158 and inserting it into one of plurality of holes 159. In an embodiment, height of leg assembly 150 is adjusted by moving plurality of depressible buttons 158 to a higher or lower hole in third leg 156 and fourth leg 157, respectively. First support bar 153 is permanently attached and is perpendicular to first leg 151 and second leg 152. Third support bar 155 is permanently attached to and is perpendicular to third leg 156 and fourth leg 157.

Figure 7B:
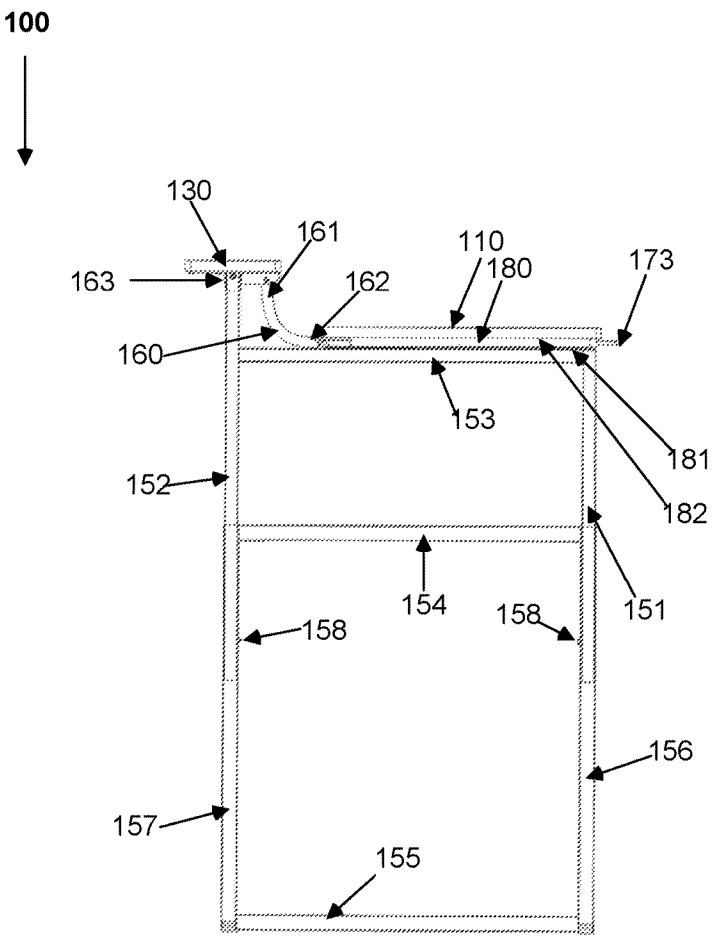
FIG. 7*b* depicts the left side view of an exemplary embodiment of a freestanding folding table.
Figure 7A:
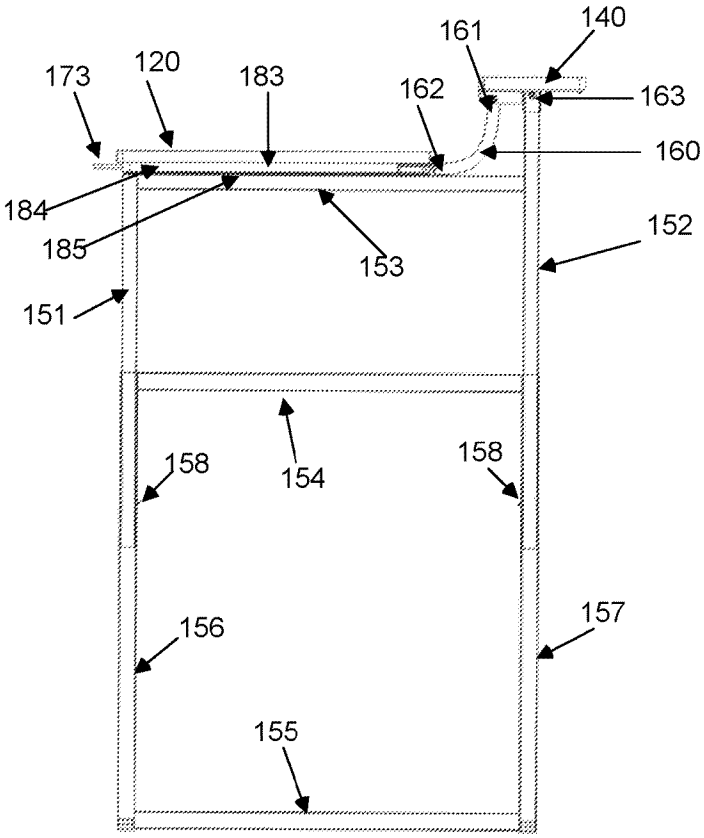
FIG. 7*a* depicts the right side view of an exemplary embodiment of a freestanding folding table.

In an alternate embodiment, second support bar 154 is perpendicular to and permanently attached to first leg 151 and second leg 152 by plurality of fasteners 163 (see FIGS. 7*a* and 7*b*).

In one embodiment, freestanding folding table 100 further comprises latch mechanism 170 (FIG. 5), wherein latch mechanism 170 comprises first latch rail 171, second latch rail 174, slide latch 172, and lever 173. In this embodiment, first latch rail 171 is permanently attached to first lower surface 112 and second latch rail 174 is permanently attached to second lower surface 122 using a plurality of fasteners 163. First latch rail 171 and second latch rail 174 meet where first top 110 and second top 120 separate. First latch rail 171 is configured to readily accept slide latch 172, wherein slide latch 172 freely moves within first latch rail 171 and second latch rail 174 to lock first top 110 and second top 120 together. In this embodiment, lever 173 protrudes from slide latch 172 to aid in the movability of slide latch 172 (see FIG. 4). When slide latch 172 is engaged or in the closed position, first top 110 and second top 120 are locked together and move as one piece. In the alternative, when slide latch 172 is disengaged or in the open position, first top 110 and second top 120 move independently of each other.

First support arm 180 and second support arm 183 are configured to provide support and stability. In one embodiment, first support arm 180 comprises first arm upper surface 181 (not shown) and first arm lower surface 182. In an embodiment, second arm 183 comprises second arm upper surface 184 (not shown) and second arm lower surface 185 (see FIG. 4). In this embodiment, first arm upper surface 181 is permanently attached to first lower surface 112 of first top 110 using a plurality of fasteners 163. First arm lower surface 182 is permanently attached to first support bar 153 of first leg 151 (see FIG. 7*b*). Likewise, second arm upper surface 184 of second arm 183 is permanently attached to second lower surface 122 of second top 120 using a plurality of fasteners 163. Second arm lower surface 185 of second arm 183 is permanently attached to first support bar 153 of first leg 151 (see FIG. 7*a*).

In one embodiment, material of construction for first top 110, second top 120, third top 130, and fourth top 140 is particle board, polycarbonate, wood, engineered wood, or any combination thereof. In an exemplary embodiment, material of construction for leg assembly 150 is metal, polyethylene plastic, aluminum or any combination thereof. One of ordinary skill in the art can envision other types of material of construction for folding table 100 that are within the scope of the present invention.

In yet another embodiment, freestanding folding table further comprises basket 186 (not shown), wherein basket 186 is removably attached between leg assembly 150 under first top 110 and leg assembly 150 under second top 120. In an alternate embodiment, basket 186 is removably attached between first top 110 and second top 120. In yet another embodiment, basket 186 is removably attached to first top 110 using a plurality of hooks. In the alternative, basket 186 is removably attached to second top 120 using a plurality of hooks.

Figure 8:
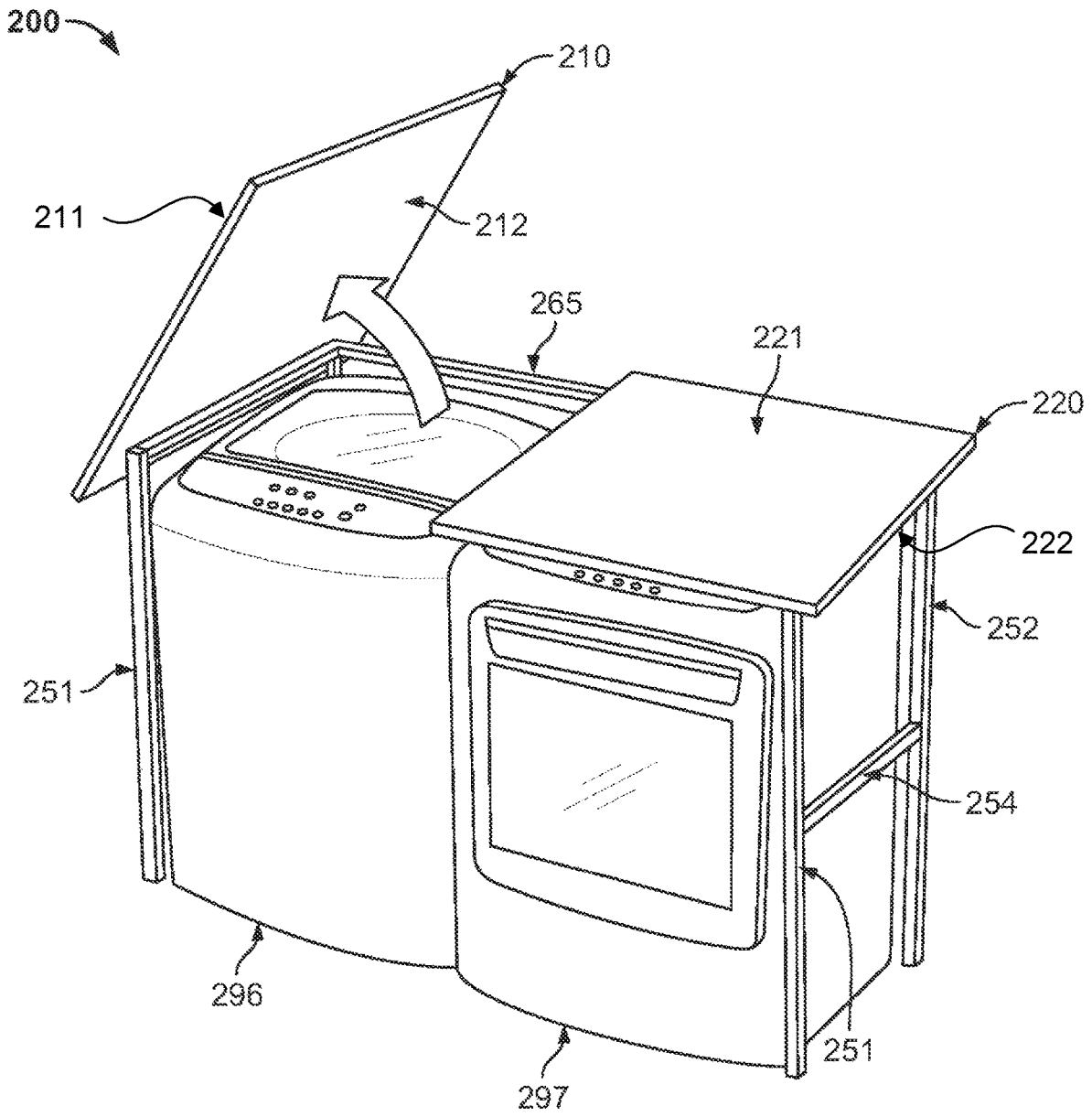
FIG. 8 depicts the perspective view of a first alternate embodiment of a freestanding folding table in which tops hinge outward away from each other.

FIG. 8 depicts the perspective view of a first alternate embodiment of a freestanding folding table. Free standing table 200 comprises first top 210 and second top 220. In one embodiment, first top 210 comprises first upper surface 211 and first lower surface 212; and second top 220 comprises second upper surface 221 and second lower surface 222. In one embodiment, folding table 200 comprises two leg assemblies 250 located at the lateral outer end of first top 210 and second top 220 providing vertical support at such ends of each first and second top 210 and 220 respectively. Free standing table 200 further comprises first leg 251; second leg 252; second support bar 254; and two U-shaped support bars 265. In this embodiment, first top 210 and second top 220 hinge outwards away from each other allowing access to top-load washer 296 and controls on dryer 297.

In this embodiment, first leg 251 and second leg 252 are permanently affixed to one of U-shaped support bar 265 using plurality of fasteners 263 in which first leg 251 is perpendicular to one of u-shaped support bars 265, second leg 252 is perpendicular to the other U-shaped support bars 265, and first leg 251 and second leg 252 are parallel to each other. Second support bar 254 is permanently affixed between first leg 251 and second leg 252 for added stability and support.

In an alternate embodiment, both U-shaped support bar 265 are permanently affixed to both first leg 251 and second leg 252 using welding. Likewise, both second support bars 254 are permanently affixed between first leg 251 and second leg 252 using welding.

Plurality of hinge bars 260 (not shown) are permanently affixed between U-shaped support bar 265 and first lower surface 212 enabling first top 210 to open outwards. Likewise, plurality of hinge bars 260 (not shown) are permanently affixed between u-shaped support bar 265 and second lower surface 222 enabling second top 220 to open outwards.

In an embodiment, first top 210 and second top 220 are capable of moving independently of each other. For example, first top 210 can be lifted up engaging the hinge bars 260 connected to the first lower surface 212 while second top 220 remains in the closed or down position. In the alternative, second top 220 can be lifted up engaging the hinge bars 260 connected to the second lower surface 222 while first top 210 remains in the closed or down position.

Figure 9:
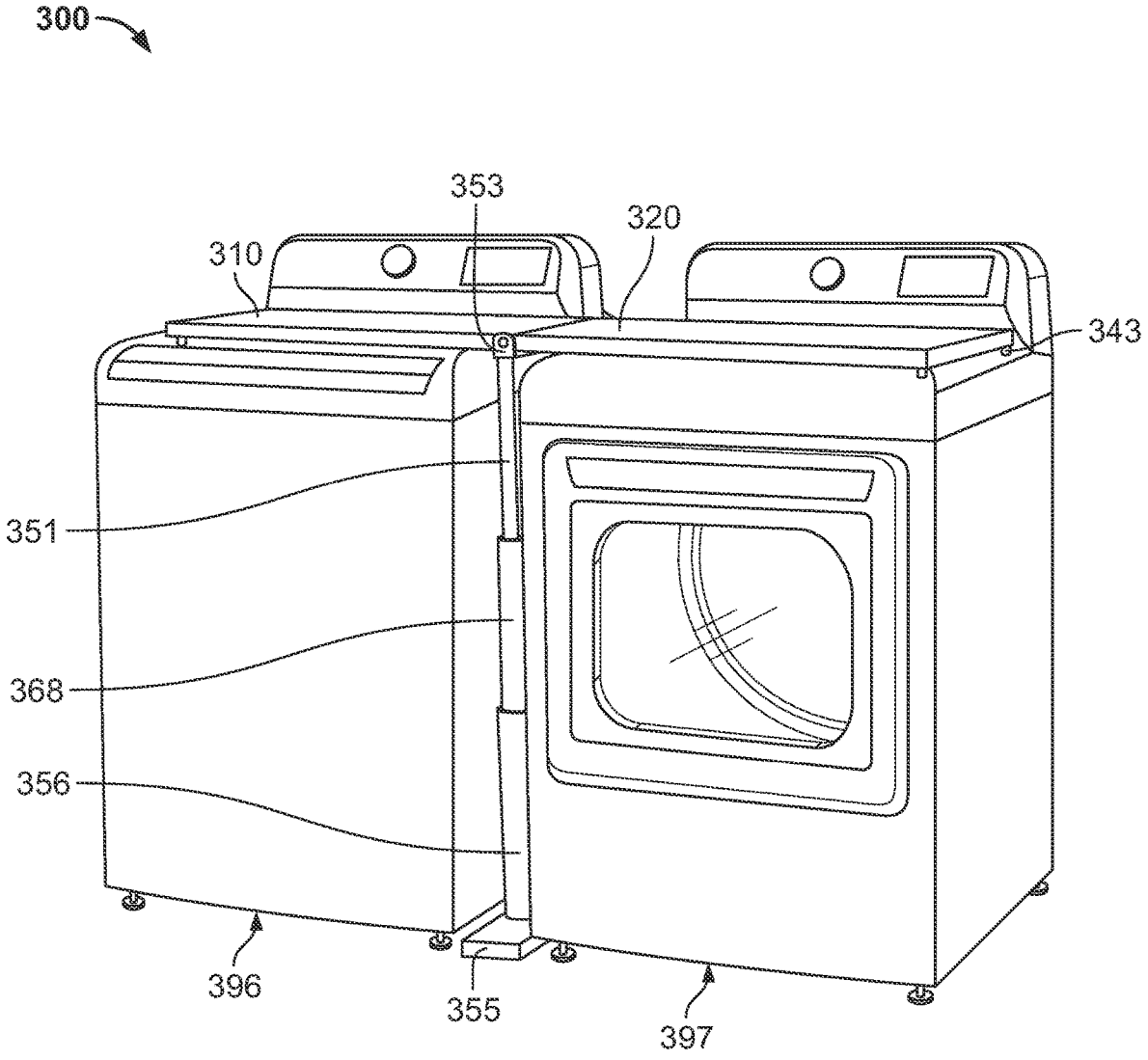
FIG. 9 depicts the perspective view of a second alternate embodiment of a freestanding folding table in which tops hinge inward toward each other.

FIG. 9 depicts the perspective view of a second alternate embodiment of freestanding folding table 300. Freestanding folding table 300 comprises first top 310, second top 320, plurality of posts 343, first support bar 353, first leg 351, second leg 352, third leg 356, fourth leg 357 (not shown), first middle leg support 368, second middle leg support 369, third support bar 355, plurality of hinge bars 360, and plurality of fasteners 363. In one embodiment, folding table 300 comprises two leg assemblies 350 located at the lateral outer end of first top 310 and second top 320 providing vertical support at such ends of each first and second top 310 and 320 respectively.

In one embodiment, first top 310 comprises first upper surface 311 and first lower surface 312; and second top 320 comprises second upper surface 321 and second lower surface 322. In this embodiment, plurality of posts 343 are permanently affixed to first lower surface 312 and second lower surface 322. In this embodiment, first top 310 and second top 320 hinge inwards toward each other.

In this embodiment, first leg 351 and second leg 352 (not shown) are permanently affixed to first support bar 353 using plurality of fasteners 363 wherein first leg 351 is perpendicular to first support bar 353, second leg 352 is perpendicular to first support bar 353, and first leg 351 and second leg 352 are parallel to each other. Third leg 356 and fourth leg 357 (not shown) are permanently affixed to third support bar 355 using plurality of fasteners 363 in which third leg 356 is perpendicular to third support bar 355, fourth leg 357 is perpendicular to third support bar 355, and third leg 356 and fourth leg 357 are parallel to each other. Third leg 356 readily accepts first middle leg support 368 which in turn readily accepts first leg 351, and fourth leg 357 readily accepts second middle leg support 369 which in turn readily accepts second leg 352, enabling each to adjust to a different height based on the user's preference. In this embodiment, first leg 351, first middle leg support 368, and third leg 356 form a telescoping leg. Likewise, second leg 352, second middle leg support 369, and fourth leg 357 form a telescoping leg enabling leg assembly 350 to be height adjustable.

Plurality of posts 343 are permanently affixed to first lower surface 312 and provide a cushion between first top 310 and washer 396. Likewise, plurality of posts 343 are permanently affixed to second lower surface 322 and provide a cushion between second top 320 and dryer 397. Plurality of hinge bars 360 (not shown) are permanently affixed between first support bar 353 and first lower surface 312 enabling first top 310 to open inward. Likewise, plurality of hinge bars 360 (not shown) are permanently affixed between first support bar 353 and second lower surface 322 enabling second top 320 to open inward.

In an embodiment, first top 310 and second top 320 are capable of moving independently of each other. For example, first top 310 can be lifted up engaging plurality of hinge bars 360 connected to first lower surface 312 while second top 320 remains in the closed or down position. In the alternative, second top 320 can be lifted up engaging plurality of hinge bars 360 connected to second lower surface 322 while first top 310 remains in the closed or down position.

Figure 10:
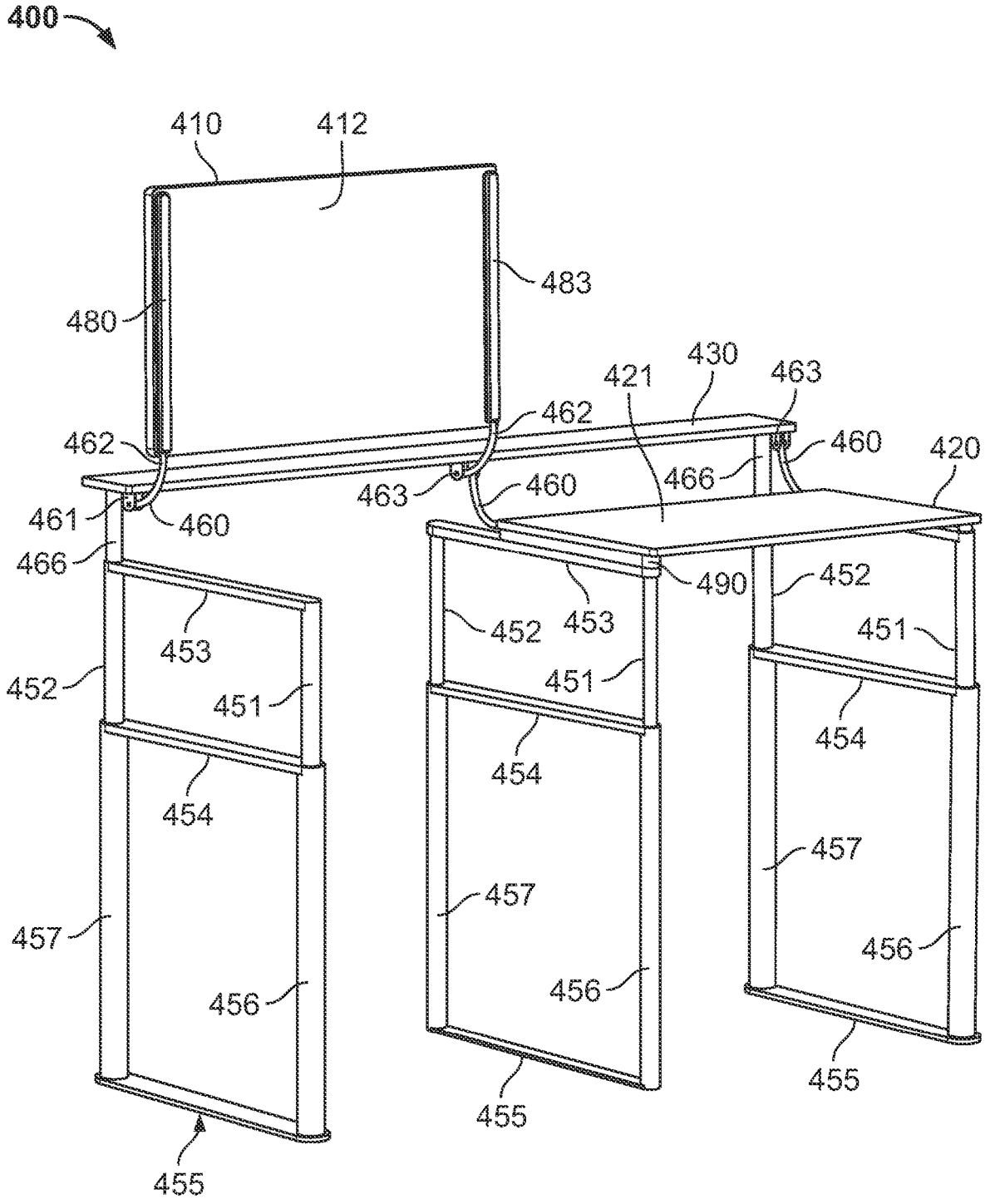
FIG. 10 depicts the perspective view of a third alternate embodiment of a freestanding folding table with three leg assemblies.

FIG. 10 depicts the perspective view of a third alternate embodiment of freestanding folding table 400. Freestanding folding table 400 comprises three leg assemblies 450. In this embodiment, freestanding folding table 400 comprises first top 410, second top 420, third top 430, fourth support bar 466, a plurality of leg assembly 450, and a plurality of hinge bars 460.

In this embodiment, first top 410 comprises first upper surface 411 and first lower surface 412; second top 420 comprises second upper surface 421 and second lower surface 422, third top 430 comprises third upper surface 431 and third lower surface 432.

In one embodiment, leg assembly 450 comprises first leg 451, second leg 452, first support bar 453, second support bar 454, third support bar 455, third leg 456, and fourth leg 457; wherein first leg 451 is perpendicular to first support bar 453, second leg 452 is perpendicular to first support bar 453, and first leg 451 and second leg 452 are parallel to each other. Third leg 456 and fourth leg 457 are permanently affixed to third support bar 455 using plurality of fasteners 463; wherein third leg 456 is perpendicular to third support bar 455, fourth leg 457 is perpendicular to third support bar 455, and third leg 456 and fourth leg 457 are parallel to each other. In one embodiment third leg 456 and fourth leg 457 are permanently affixed to second support bar 454 using plurality of fasteners 463; wherein third leg 456 is perpendicular to second support bar 454, fourth leg 457 is perpendicular to second support bar 454, third leg 456 and fourth leg 457 are parallel to each other, and second support bar 454 is parallel to third support bar 455. Fourth support bar 466 is permanently affixed between third lower surface 432 and second leg 452 for added support on each end leg assembly 450.

In an alternate embodiment, the means of attachment for leg assembly 450 comprises welding, soldering or brazing.

In yet another embodiment, leg assembly 450 is height adjustable and further comprises a plurality of depressible buttons 458 and plurality of holes 459. First leg 451 and second leg 452 each comprise depressible buttons 458, and third leg 456 and fourth leg 457 each comprises a plurality of holes 459, wherein plurality of holes 459 readily accepts depressible button 458 allowing leg assembly 450 to be height adjustable. Moving depressible button 458 to a higher hole on third leg 456 and fourth leg 457 enables folding table 400 to become taller. In the alternative, moving depressible button 458 to a lower hole on third leg 456 and fourth leg 457 enables folding table 400 to become shorter.

In yet another embodiment, hinge bar 460 comprises first end 461, second end 462, and a plurality of fasteners 463; wherein first end 461 is fixedly attached to third lower surface 432 of third top 430 using a plurality of fasteners 463; and wherein second end 462 of hinge bar 460 is fixedly attached to first lower surface 412 of first top 410. Likewise, first end 461 is fixedly attached to third lower surface 432 of third top 430 using a plurality of fasteners 463; wherein second end 462 of hinge bar 460 is fixedly attached to second lower surface 422 of second top 420. In this embodiment, freestanding folding table 400 is configured to have two tops that open independently. For example, first top 410 can be lifted up engaging hinge bars 460 connected to first lower surface 412 while second top 420 remains in the closed or down position. In the alternative, second top 420 can be lifted up engaging hinge bars 460 connected to second lower surface 422 while first top 410 remains in the closed or down position.

In an alternate embodiment, folding table 400 further comprises first arm 480, second arm 483, third arm 490, and fourth arm 493 (not shown); wherein first arm 480 and second arm 483 are permanently attached to first lower surface 412; and third arm 490 and fourth arm 493 are permanently attached to second lower surface 422. In this embodiment, first arm 480 and second arm 483 provide added support for first top 410 while third arm 490 and fourth arm 493 provide added support for second top 420. In this embodiment, third top 430 is a static shelf that is the length of folding table 400 and provides a user additional storage space.

Figure 11:
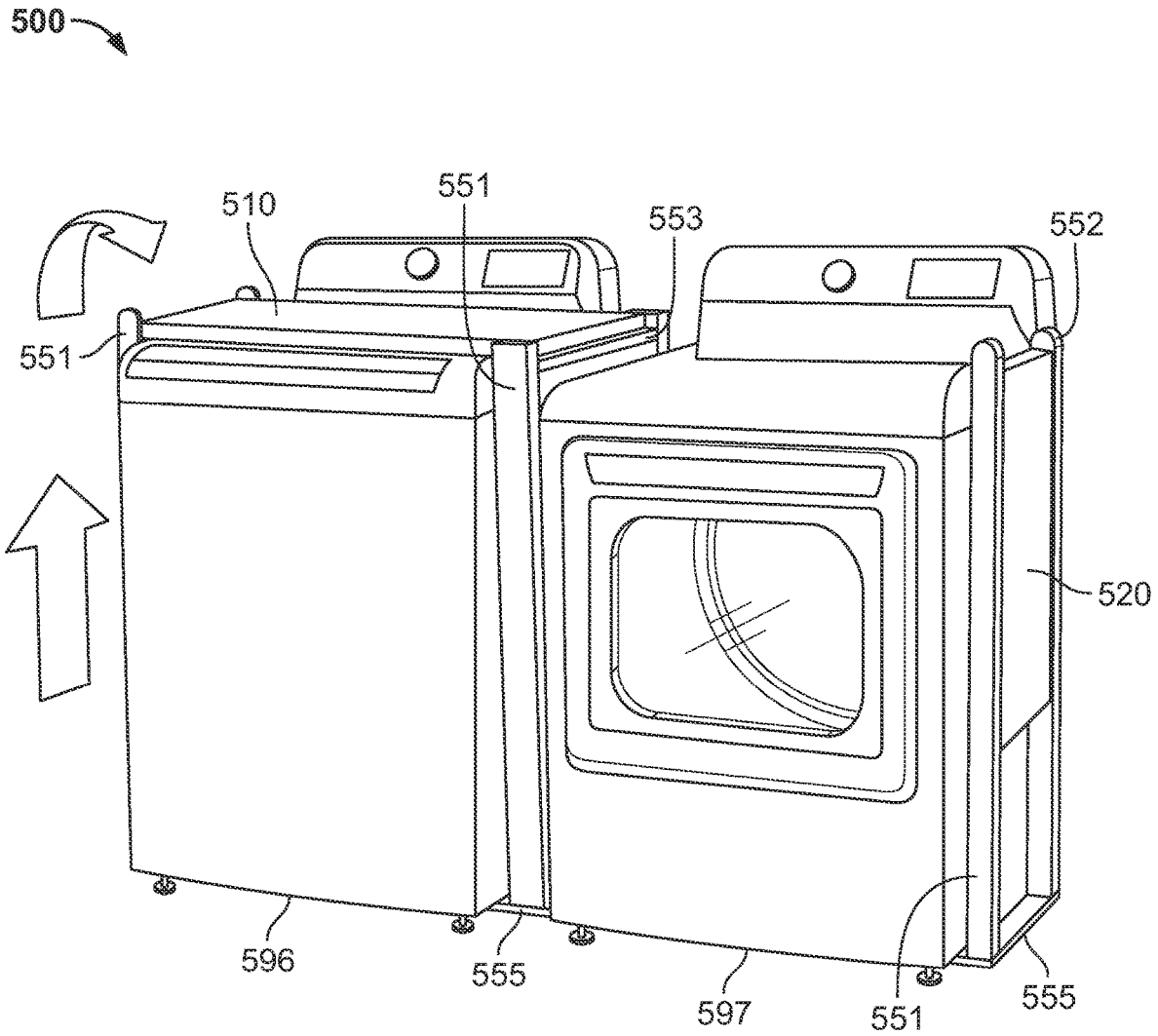
FIG. 11 depicts the perspective view of a fourth alternate embodiment of a freestanding folding table in which leg assemblies readily accept tops.
Figure 12:
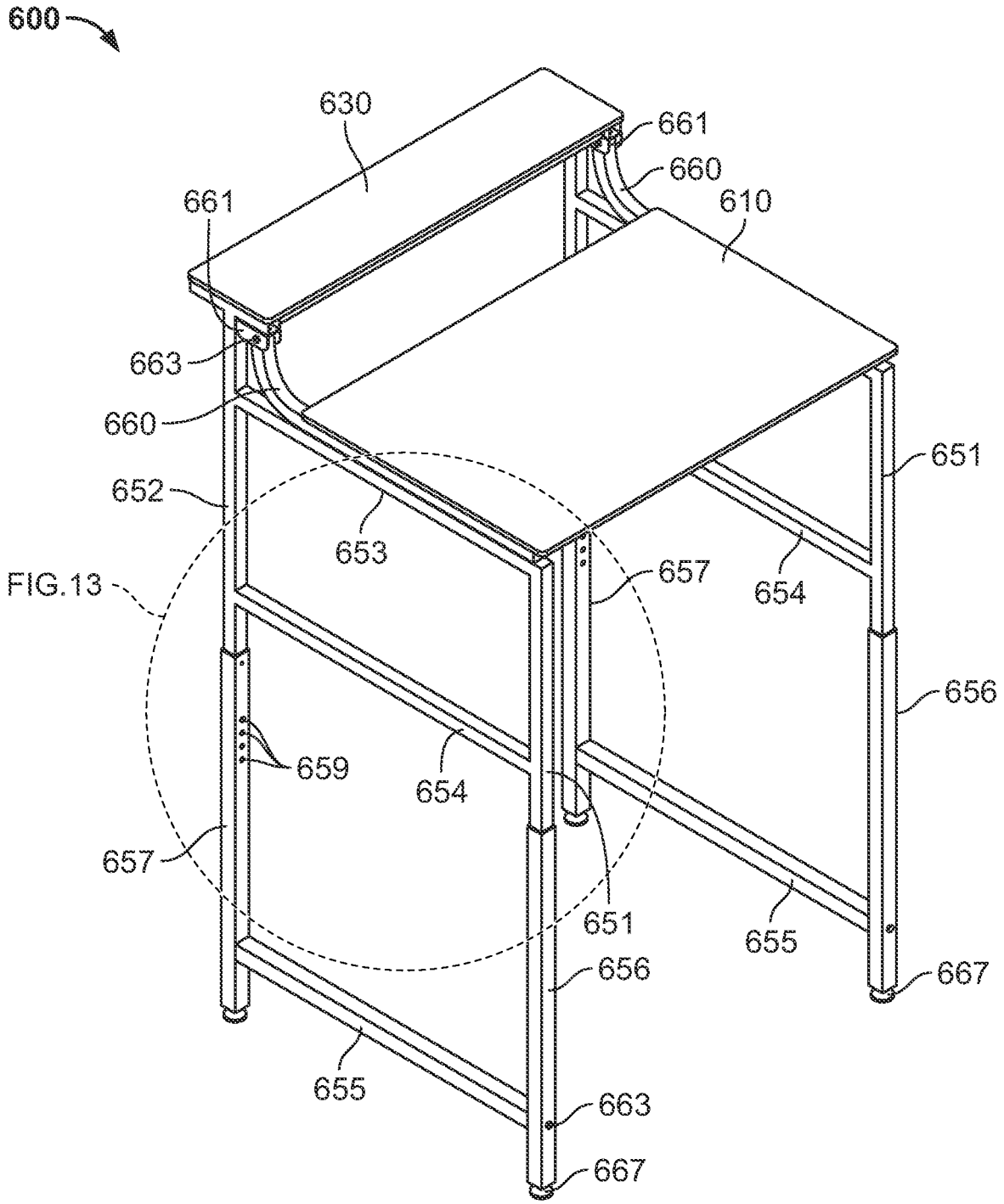
FIG. 12 depicts the perspective view of a fifth alternate embodiment of a freestanding folding table.
Figure 13:
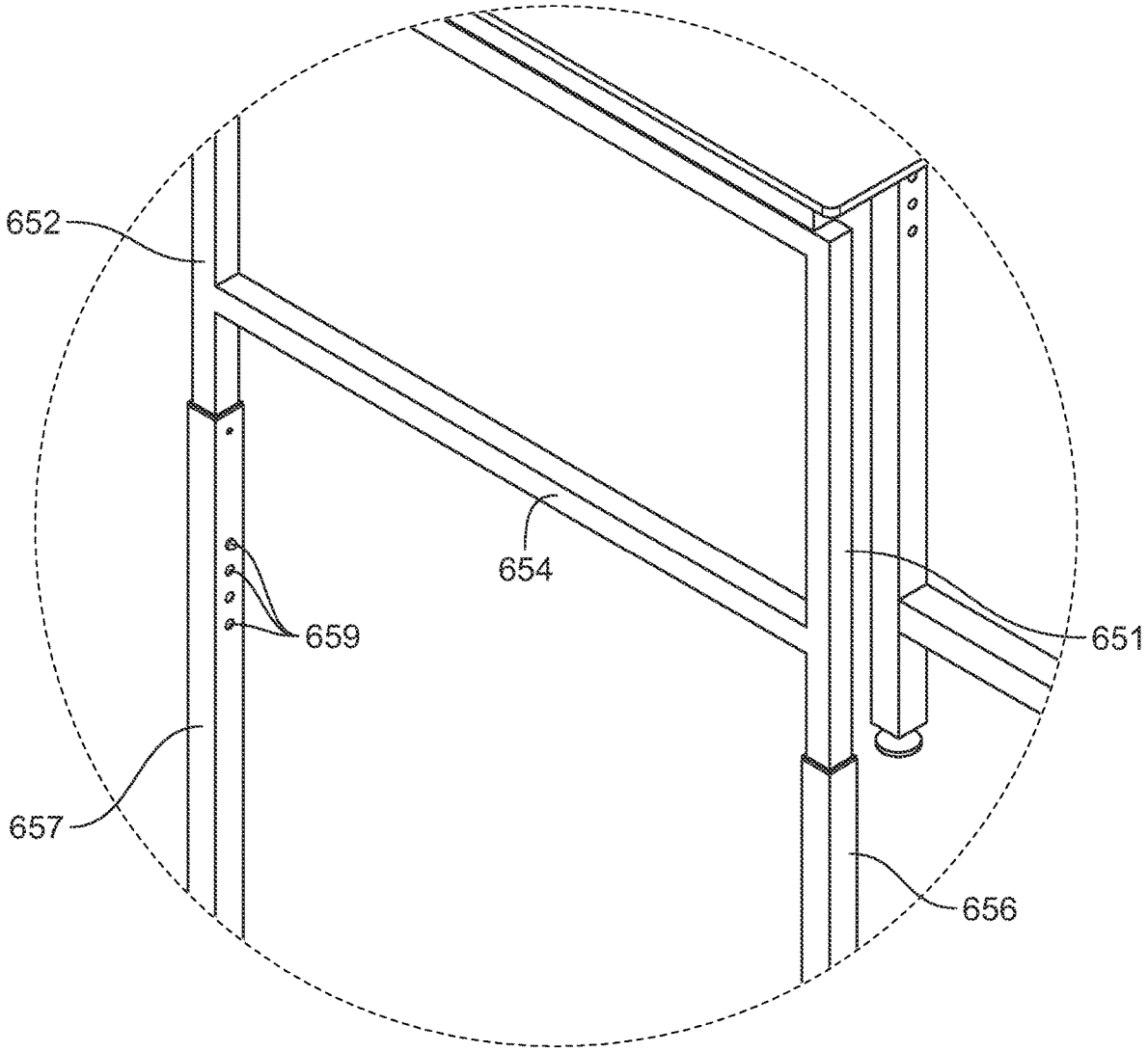
FIG. 13 depicts a close-up perspective view of an alternate embodiment of a leg assembly on a freestanding folding table.
Figure 14B:
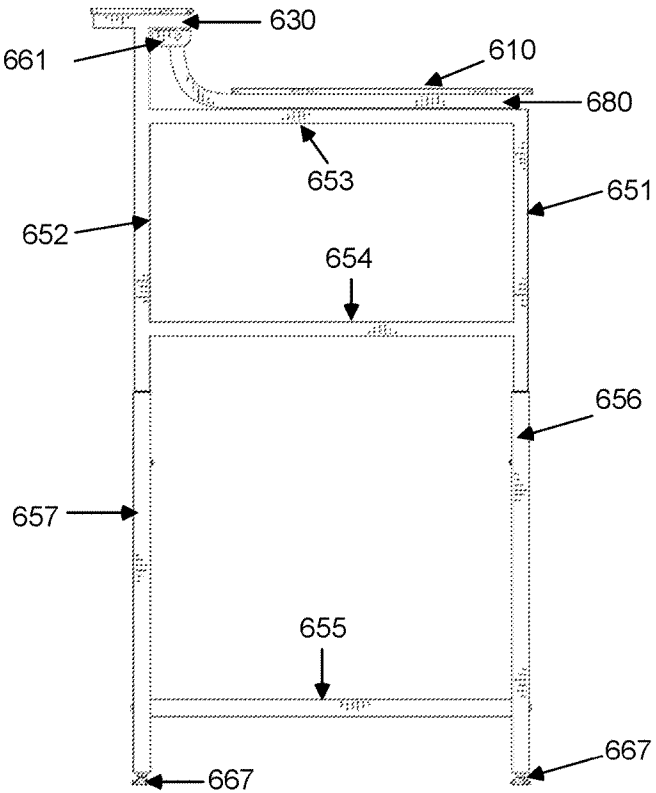
FIG. 14*b* depicts the left side view of an alternate embodiment of a freestanding folding table.
Figure 14A:
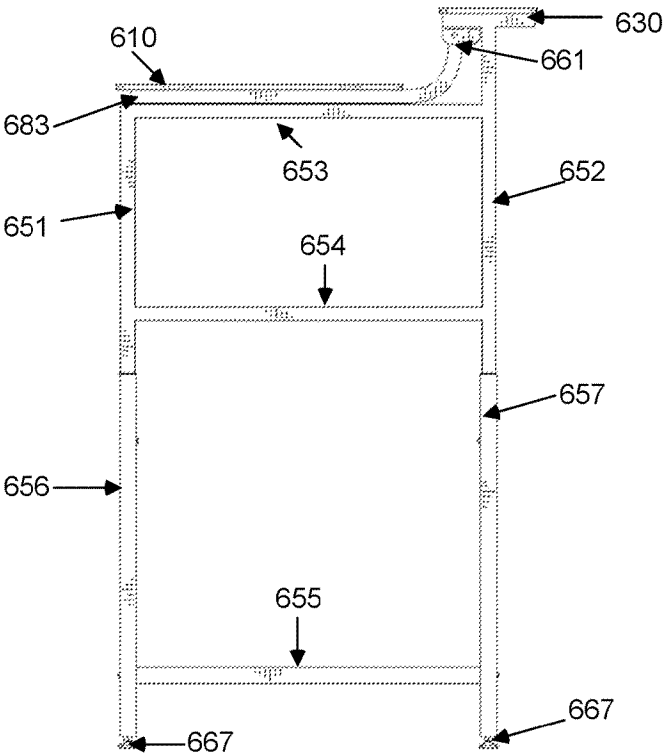
FIG. 14*a* depicts the right side view of an alternate embodiment of a freestanding folding table.

FIG. 11 depicts the perspective view of a fourth alternate embodiment of freestanding folding table 500. Freestanding folding table 500 comprises first top 510, second top 520, and leg assembly 550; wherein leg assembly 550 comprises first leg 551, second leg 552, first support bar 553, and third support bar 555. Leg assembly 550 is configured to readily accept first top 510 and second top 520.

In this embodiment, first leg 551 is perpendicular to third support bar 555, second leg 552 is perpendicular to third support bar 555, and first leg 551 and second leg 552 are parallel to each other. First leg 551 and second leg 552 are permanently affixed to third support bar 555 using plurality of fasteners 563. In addition, first leg 551 and second leg 552 have a groove along the inside surface facing each other that is capable of accepting either first top 510 or second top 520. Leg assembly 550 further comprises first support bar 553 capable of supporting ends of first top 510 and second top 520 when in the closed position.

In an alternate embodiment, the means of attachment for leg assembly 550 comprises welding, soldering or brazing.

FIGS. 12-14*b* depict the perspective view of a fifth alternate embodiment of freestanding folding table 600. Freestanding folding table 600 is configured to be height adjustable and fit over a washer or a dryer or a utility tub. In this embodiment, freestanding folding table 600 comprises first top 610, second top 630, two leg assembly 650, first support arm 680, second support arm 683, and a plurality of hinge bars 660.

In an embodiment, first top 610 comprises first upper surface 611 and first lower surface 612; second top 630 comprises second upper surface 631 and second lower surface 632. Support arms 680 and 683 are configured to provide support and stability for operating freestanding folding table 600. First support arm 680 comprises first arm upper surface 681 and first arm lower surface 682; and second support arm 683 comprises second arm upper surface 684 and second arm lower surface 685.

In one embodiment, first arm upper surface 681 is permanently attached to first lower surface 612 using a plurality of fasteners 663. First arm lower surface 682 of first arm 680 is permanently attached to first support bar 653 of first leg 651. Likewise, second arm upper surface 684 is permanently attached to first lower surface 612 at the opposite end of first support arm 680 using a plurality of fasteners 663. Second arm lower surface 685 is permanently attached to first support bar 653 of first leg 651.

In an embodiment, hinge bar 660 comprises first end 661, second end 662, and a plurality of fasteners 663; wherein first end 661 is fixedly attached to first support arm 680 using a plurality of fasteners 663; and wherein second end 662 of hinge bar 660 is fixedly attached to first lower surface 612 of first top 610 (not shown). Likewise, second end 662 is fixedly attached to second support arm 683 using a plurality of fasteners 663; and wherein second end 662 of hinge bar 660 is fixedly attached to the opposite end of first lower surface 612 of first top 610.

In yet another embodiment, freestanding folding table 600 further comprises a plurality of foot leveler 667 positioned on ends of third leg 656 and fourth leg 657 which are configured in keeping folding table 600 level.

In this embodiment, freestanding folding table 600 is configured to have one top that opens up towards second top 630. For example, first top 610 can be lifted up engaging the hinge bars 660 connected to the first lower surface 612.

In an embodiment, leg assembly 650 comprises first leg 651, second leg 652, first support bar 653, second support bar 654, third support bar 655, third leg 656, and fourth leg 657; wherein first leg 651 is perpendicular to first support bar 653, second leg 652 is perpendicular to first support bar 653, and first leg 651 and second leg 652 are parallel to each other. Third leg 656 and fourth leg 657 are permanently affixed to third support bar 655 using plurality of fasteners 663; wherein third leg 656 is perpendicular to third support bar 655, fourth leg 657 is perpendicular to third support bar 655, and third leg 656 and fourth leg 657 are parallel to each other. Third leg 656 and fourth leg 657 are permanently affixed to second support bar 654 using plurality of fasteners 663; wherein third leg 656 is perpendicular to second support bar 654, fourth leg 657 is perpendicular to second support bar 654, third leg 656 and fourth leg 657 are parallel to each other, and second support bar 654 is parallel to third support bar 655. Second leg 652 extends up to third lower surface 632 for added support on each leg assembly 650.

In another embodiment, leg assembly 650 is height adjustable and further comprises of a plurality of repressible buttons 658 and plurality of holes 659. First leg 651 and second leg 652 each comprise repressible buttons 658, and third leg 656 and fourth leg 657 each comprises a plurality of holes 659, wherein plurality of holes 659 readily accepts repressible buttons 658 allowing leg assembly 650 to be height adjustable. Moving repressible button 658 to a higher hole on third leg 656 and fourth leg 657 enables folding table 600 to become taller. In the alternative, moving repressible button 658 to a lower hole on third leg 656 and fourth leg 657 enables folding table 600 to become shorter (see FIG. 13).

Thus, different embodiments of a freestanding folding table have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A freestanding folding table, comprising:

a. a first top, wherein said first top comprises a first upper surface and a first lower surface;

b. a leg assembly, wherein said leg assembly comprises a first leg, a second leg, a first support bar, and a third support bar, wherein:

i. said first leg is perpendicular to and permanently attached to said first support bar and said third support bar;

ii. said second leg is perpendicular to and permanently attached to said first support bar and said third support bar, and first leg and second leg are parallel to each other;

c. a second top, wherein said second top comprises a second upper surface and a second lower surface;

d. a plurality of hinge bars, wherein said hinge bars comprise a first end, a second end, and a plurality of fasteners, wherein:

i. said first end is fixedly attached to said lower surface of said second top using said plurality of fasteners; and ii. second end of said hinge bar is fixedly attached to first lower surface of first top enabling said first top to hinge upward toward said second top; and e. a means of attachment, wherein said means of attachment secures said lower second surface to said first end; said lower first surface to said second end; and said lower surface to leg assembly.

2. The freestanding folding table as recited in claim 1, wherein said freestanding folding table further comprises:

a. a first support arm, wherein said first support arm comprises a first support arm upper surface and a first support arm lower surface; and b. a second support arm, wherein said second support arm comprises a second support arm upper surface and a second support arm lower surface;

wherein:

i. said first support arm upper surface of said first support arm is permanently attached to said first support lower surface of said first top using said plurality of fasteners, and ii. said first support arm lower surface of said first support arm is permanently attached to said first support bar of said leg assembly, and said second arm upper surface of said second arm is permanently attached to said first lower surface of said first top using said plurality of fasteners, and iii. said second support arm lower surface of said second support arm is permanently attached to said first support bar of said leg assembly.

3. The freestanding folding table as recited in claim 1, wherein said freestanding folding table further comprises:

a. a third top, wherein said third top comprises a third upper surface and a third lower surface;

b. a first support arm, wherein said first support arm comprises a first support arm upper surface and a first support arm lower surface; and c. a second support arm, wherein:

i. said second support arm comprises a second support arm upper surface and a second support arm lower surface;

ii. said first support arm upper surface of said first support arm is permanently attached to said first lower surface of said first top using said plurality of fasteners;

iii. said first support arm lower surface of said first support arm is permanently attached to said first support bar of said leg assembly;

iv. said second support arm upper surface of said second support arm is permanently attached to said second lower surface of said second top using said plurality of fasteners; and v. said second support arm lower surface of said second support arm is permanently attached to said first support bar of said leg assembly.

4. The freestanding folding table as recited in claim 3, wherein said freestanding folding table further comprises a latch mechanism, wherein said latch mechanism comprises:

a. a first latch rail and a second latch rail, wherein:

i. said first latch rail is permanently affixed to said first lower surface;

ii. said second latch rail is permanently affixed to said second lower surface using said plurality of fasteners; and iii. said first latch rail and said second latch rail align;

b. a slide latch, wherein said slide latch is movable between said first latch rail and said second latch rail; and c. a lever, located on said slide latch enabling movement of said slide latch between said first top and said second top.

5. The freestanding folding table as recited in claim 4, wherein said leg assembly further comprises a third leg, a fourth leg, a second support bar, a plurality of depressible buttons, and a plurality of holes, wherein:

i. said first leg is of a smaller diameter than said third leg;

ii. said second leg is of a smaller diameter than said fourth leg;

iii. said third leg readily accepts said first leg by inserting one of said depressible buttons in one of said plurality of holes and said fourth leg readily accepts said second leg, by inserting one of said depressible buttons in one of said plurality of holes; and iv. height of said leg assembly is adjusted by moving one of said plurality of depressible buttons to a higher or lower said plurality of holes in said third leg and said fourth leg.

6. The freestanding folding table as recited in claim 5, wherein said freestanding folding table further comprises a plurality of foot levelers permanently attached to the ends of said third leg and said fourth leg.

7. The freestanding folding table as recited in claim 6, wherein said freestanding folding table further comprises a third leg assembly.

8. The freestanding folding table as recited in claim 1, wherein said means of attachment comprises a plurality of fasteners, or welding.

9. A freestanding folding table, comprising:

a. a first top, wherein said first top comprises a first upper surface and a first lower surface;

b. a second top, wherein said second top comprises a second upper surface and a second lower surface;

c. a leg assembly, wherein said leg assembly comprises a first leg, a second leg, a first support bar, and a third support bar, i. wherein said first leg is perpendicular to and permanently attached to said first support bar and said third support bar;

ii. said second leg is perpendicular to and permanently attached to said first support bar and said third support bar; and iii. first leg and second leg are parallel to each other, d. a third top, wherein said third top comprises a third upper surface and a third lower surface;

e. a plurality of hinge bars, wherein:

i. said hinge bars comprise a first end, a second end, and a plurality of fasteners;

ii. at least two hinge bars are permanently affixed to first top;

iii. said first end is fixedly attached to said lower surface of said third top using said plurality of fasteners and second end of said hinge bar is fixedly attached to first lower surface of first top enabling said first top to hinge upward toward said third top; and iv. at least two hinge bars are permanently affixed to second top, wherein said first end is fixedly attached to said lower surface of said third top using a plurality of fasteners and said second end of said hinge bar is fixedly attached to second lower surface of second top; and f. a means of attachment, wherein said means of attachment secures said first lower surface to said second end of said at least two hinge bars; said second lower surface to second end of said at least two hinge bars; and said third lower surface to said leg assembly.

10. The freestanding folding table as recited in claim 9, wherein said freestanding folding table further comprises a first support arm and a second support arm, wherein:

i. said first support arm comprises a first support arm upper surface and a first support arm lower surface;

ii. said second support arm comprises a second support arm upper surface and a second support arm lower surface;

iii. said first support arm upper surface of said first support arm is permanently attached to said first lower surface of said first top using said plurality of fasteners;

iv. said first support arm lower surface of said first support arm is permanently attached to said first support bar of said leg assembly;

v. said second support arm upper surface of said second support arm is permanently attached to said second lower surface of said second top using said plurality of fasteners; and vi. said second support arm lower surface of said second support arm is permanently attached to said first support bar of said leg assembly.

11. The freestanding folding table as recited in claim 10, wherein:

i. said leg assembly further comprises a third leg, a fourth leg, a second support bar, a plurality of depressible buttons, and a plurality of holes;

ii. said first leg is of a smaller diameter than said third leg;

iii. said second leg is of a smaller diameter than said fourth leg;

iv. said third leg readily accepts said first leg by inserting one of said depressible buttons in one of the said plurality of holes and said fourth leg readily accepts said second leg by inserting one of said depressible buttons in one of said plurality of holes, and v. height of said leg assembly is adjusted by moving one of said depressible buttons to a higher or lower said plurality of holes in said third leg and said fourth leg.

12. The freestanding folding table as recited in claim 9, wherein said freestanding folding table further comprises a latch mechanism, wherein said latch mechanism comprises:

a. a first latch rail and a second latch rail;

wherein:

i. said first latch rail is permanently affixed to said first lower surface;

ii. said second latch rail is permanently affixed to said second lower surface using said plurality of fasteners; and iii. said first latch rail and said second latch rail align, b. a slide latch, wherein said slide latch is movable between said first latch rail and said second latch rail; and c. a lever, located on said slide latch enabling movement of said slide latch between said first top and said second top.

13. The freestanding folding table as recited in claim 9, wherein said freestanding folding table further comprises a third leg assembly.

14. The freestanding folding table as recited in claim 9, wherein said means of attachment comprises a plurality of fasteners or welding.

15. A freestanding folding table, comprising:

a. a first top, wherein said first top comprises a first upper surface and a first lower surface;

b. a second top, wherein said second top comprises a second upper surface and a second lower surface;

c. a plurality of posts, wherein said posts are permanently affixed to said first lower surface and said second lower surface;

d. a leg assembly, wherein:

i. said leg assembly comprises a first leg, a second leg, a third leg, a fourth leg, a first middle leg support, a second middle leg support, and a third support bar;

ii. said first leg, said first middle leg support, and said third leg form a telescoping leg;

iii. wherein said second leg, said second middle leg support, and said fourth leg form a telescoping leg enabling said leg assembly to be height adjustable; and iv. said telescoping legs are parallel to each other and permanently affixed to and perpendicular to said first support bar and said third support bar; and e. a plurality of hinge bars, wherein:

i. said hinge bars comprise a first end, a second end, and a plurality of fasteners;

ii. said first end is fixedly attached to said first support bar of said leg assembly using said plurality of fasteners;

iii. said second end of said hinge bar is fixedly attached to first lower surface of first top enabling said first top to hinge inward toward said second top; and iv. said first end is fixedly attached to said first support bar of said leg assembly using said plurality of fasteners and said second end of said hinge bar is fixedly attached to second lower surface of second top enabling said second top to hinge inward toward said first top.

16. The freestanding folding table as recited in claim 15, wherein said means of attachment comprises a plurality of fasteners or welding.

* * * * *